US006318251B1

(12) United States Patent
Schulz

(10) Patent No.: US 6,318,251 B1
(45) Date of Patent: Nov. 20, 2001

(54) AUTOMATIC CONTROL SYSTEM FOR A TRUSS FABRICATING MACHINE

(76) Inventor: Jack A. Schulz, Rte. 1 Box 285, Monett, MO (US) 65708

( * ) Notice: Subject to any disclaimer, the term of this patent is extended or adjusted under 35 U.S.C. 154(b) by 0 days.

(21) Appl. No.: 09/408,325

(22) Filed: Sep. 29, 1999

Related U.S. Application Data

(60) Provisional application No. 60/102,984, filed on Oct. 3, 1998.

(51) Int. Cl.[7] ..... B30B 15/26; B30B 15/16

(52) U.S. Cl. ..... 100/48; 100/100; 100/226; 100/913; 227/152

(58) Field of Search ..... 100/43, 48, 100, 100/226, 913; 227/152; 269/910; 29/432, 798

(56) References Cited

U.S. PATENT DOCUMENTS 5,048,409 9/1991 Schulz ..... 100/48

FOREIGN PATENT DOCUMENTS

2693148 A1 * 1/1994 (FR) ..... 100/913

OTHER PUBLICATIONS

WordPerfect® Version 6.0 for Windows User's Guide, chapter entitled "Macros," pp. 524–531, and Lesson 31 entitled "Macros," pp. 187–191 (1994).

* cited by examiner

*Primary Examiner*—Stephen F. Gerrity
(74) *Attorney, Agent, or Firm*—Jonathan A. Bay

(57) ABSTRACT

A truss fabrication machine has processing circuitry for partially automating the fabrication of trusses. One or more workers place in jig stops on the tabletop a set of loose pre-cut truss members and the connector plates that get seated at the joints therebetween. The machine has a pressing head for seating the connector plates, which rides on a gantry above the tabletop in generally a Y-axis, wherein the gantry rides on a track generally along an X-axis. There are drivers to drive the gantry along the track and the pressing head along the gantry, as well an actuator for the pressing head. The processing circuitry is reliant on X- and Y-axis sensors for reckoning position on the tabletop. The processing circuitry is given control over the gantry, the pressing-head driver and actuator for coordinating movement of the gantry and pressing head between one given X and Y position to succeeding X and Y positions, and then actuating or not the actuating means. Alternatively the pressing head might pause in a standby mode following completion of a given truss sufficiently long to allow a worker to remove the completed truss and place back in the jig stops the loose pre-cut truss members and the connector plates, and so on, which will allow the fabrication of a succeeding truss, repetitively.

20 Claims, 5 Drawing Sheets

+X
-X
+Y
-Y
10
12
14
16
18
20
22
22a
22b
24
26
28
30
32
34
36
38
40
42
44
45
46
48
50
52
54
56
58
60
62
64
66
68
70
72
94
96
98
100
102
124

Run Program

210

Various program events with "Begin Recording"

"Select Record Mode -- Joystick Mode" (ie., move Head to a position, and)
"Select" (parameter or command)
"Enter" (position coordinates and command)
Enter coordinates (x,y) for parameter
"Origin Position (x,y)"
Enter coordinates (x,y) for parameter
"Home Position (x,y)"
Enter coordinates (x,y) for command
"Move Head to press position (x,y) and Press"
Enter coordinates (x,y) for command
"Move Head to standby position (x,y) and Standby"
"Home" (inserts command to move Head to Home position and idle in Standby mode)
"Origin" inserts command to move Head to Origin position and idle in Standby mode)

"Select Record Mode -- Key-In Mode" (ie., manually key-in a position, and)
"Select" (parameter or command)
"Enter" (position coordinates and command)
Enter coordinates (x,y) for parameter
"Origin Position (x,y)"
Enter coordinates (x,y) for parameter
"Home Position (x,y)"
Enter coordinates (x,y) for command
"Move Head to press position (x,y) and Press"
Enter coordinates (x,y) for command
"Move Head to standby position (x,y) and Standby"
"Home" (inserts command to move Head to Home position and idle in Standby mode)
"Origin" inserts command to move Head to Origin position and idle in Standby mode)

"Pause" (while Recording or Playing)

"Save and compile" (current document as an executable file,
query for filename, and
quit "Begin Recording")

Various program events with "Play," "Edit, " "Copy" and so on.

"Play" (Play or resume Play after Pause of current document or executable file)
"Pause" (while Playing)
"Edit" (edit command, parameter, coordinates, or sequence thereof)
"Save and compile"
"Close" (query if Close w/o saving changes)

"Copy" (copy execution, merge or data files from another folder or drive)
"Open" (open execution, merge or data file by filename)
"Merge" (merge data file with merge file to develop an executable document)
"Play" (current executable document or file)
"Command Editor" (manually program an original execution, merge or data file)
"Save" or else "Save and Compile"
"Close" (query if Close w/o saving changes)

Quit Program

Fig. 8

AUTOMATIC CONTROL SYSTEM FOR A TRUSS FABRICATING MACHINE

CROSS-REFERENCE TO PROVISIONAL APPLICATION(S)

This application claims the benefit of U.S. Provisional Application No. 60/102,984, filed Oct. 03, 1998.

BACKGROUND OF THE INVENTION

The present invention is directed to a machine for fabrication of roof trusses and, more particularly, to an automatic control system for such a machine for fabrication of roof trusses. A number of additional features and objects will be apparent in connection with the following discussion of preferred embodiments and examples.

Pitched roofs are commonly supported by roof trusses. Roof trusses are commonly constructed of wood, particularly for wood-framed structures and residences. Roof trusses are manufactured in a wide variety of shapes and sizes according to the needs encountered in erecting a specific building. Because the roof line is usually fairly uniform throughout much of the length of a single building, many identical trusses are needed for a single building.

It has long been known that such trusses can be fabricated more efficiently through use of a truss table than they can by manual methods at the job site. The truss table is setup so that each precut piece of a particular truss fits into a channel created by parallel raised members fastened to the top of the truss table. When all the pieces for a single truss have been put in place on the truss table, they are fastened together. Nails, staples, and other similar fasteners have long been used. For some time, it has been common practice to fasten many of the joints, particularly those bearing greater loads, with connector plates, which consist of a flat plate having a large number of downward projecting parallel spikes generally created by pressing a flat plate within a specially designed die. A connector plate is seated on both the top and bottom sides of the joint as the truss lies on the truss table.

The connector plates may be seated by hammering or the like. Substantial forces are required to seat the connector means of a machine.

A truss fabricating machine includes a gantry movable along an X-axis and a pressing cylinder suspended from the gantry which is movable along the Y-axis allowing the pressing cylinder to be located above a joint in a wooden truss. The pressing cylinder presses down to seat connector plates into selected joints of the truss. A joystick generates electrical signals proportional to the direction and extent of movement of the joystick by the operator, which are converted to pulse width modulated electrical signals in a driver, whose output controls proportional solenoids that drive infinite positioning four-way hydraulic valves to actuate hydraulic motors that drive the gantry and pressing mechanism along either the X-axis, or through a separate hydraulic circuit, the Y-axis. The pressing cylinder can be moved along both axes simultaneously. When the pressing cylinder is in the desired position, a thumb switch on top of the joystick is actuated, causing the ram of the pressing cylinder to descend until it seats the connector plate. Releasing the thumb switch causes the ram to move upward to the top of its stroke.

What is needed is an automatic or partially-automatic control system for such a truss fabrication machine to enhance the efficiency and ensure the maintenance of quality standards in the fabrication of trusses.

SUMMARY OF THE INVENTION

It is an object of the invention to provide a truss fabrication machine with a processor or computer-implemented control system for automating or partially automating the fabrication of trusses thereon.

It is another object of the invention that such a processor or computer-implemented control system for a truss fabrication machine include access to storage devices for retrieval of pre-programmed or "canned" profiles of diverse truss configurations.

It is an alternate object of the invention that the above truss fabrication machine incorporate a manual command controller for not only operating the machine in a manual mode, but also for programmning the processor or computer-implemented control system by virtue of manually sequencing the machine through a given profile and having the processor or computer-implemented control system RECORD such sequence for automatic PLAY BACK later.

It is an additional object of the invention that the foregoing processor or computer-implemented control system include an editor for coding and/or editing the encoded instructions which govern such processor or computer-implemented control system.

These and other aspects and objects are provided according to the invention in a truss fabrication machine that is linked with processing circuitry for partially automating the fabrication of trusses. One or more workers place in jig stops on the tabletop a set of loose pre-cut truss members and the connector plates that get seated at the joints therebetween. The machine has a pressing head for seating the connector plates, which rides on a gantry above the tabletop in generally a Y-axis, wherein the gantry rides on a track generally along an X-axis. There are drivers to drive the gantry along the track and the pressing head along the gantry, as well an actuator for the pressing head. The processing circuitry is reliant on X- and Y-axis sensors for reckoning position on the tabletop. The processing circuitry is given control over the gantry, the pressing-head driver and actuator for coordinating movement of the gantry and pressing head between one given X and Y position to succeeding X and Y positions, and then actuating or not the actuating means. Alternatively, the pressing head might pause in a standby mode following completion of a given truss sufficiently long to allow a worker to remove the completed truss and place back in the jig stops the loose pre-cut truss members and the connector plates, and so on, which will allow the fabrication of a succeeding truss, repetitively.

In one example of the invention, pressing-unit moving means may comprise a motor, a drive shaft, and a drive transmission for driving the pressing unit along the gantry. That way, the Y-axis sensing means might comprise a shaft encoder coupled to the motor shaft for generating signals corresponding to Y-axis displacement. The drive transmission might comprise a chain and sprocket arrangement.

Also, the X-axis sensing means might comprise a photoelectric encoder mounted to one of the gantry or a carriage of the track and carriage means. The photoelectric encoder is preferably aimed at a strip on the tabletop, or otherwise somewhere else with the table. The stip will include photoelectric graduations allowing the photoelectric encoder to generate signals corresponding to X-axis displacement of the gantry. Such photoelectric graduations might be a marking stripe having dark and light alternations, or else a series of uniform notches, and so on.

An inventive aspect relates to the processing circuitry being configured with communication paths and ports sufficient for accessing pre-programmed profiles or instruction sets from storage in or on any of the following:—ie., chip memory, a hard disk, a floppy disk, a CD, or from alternative other remote devices accessible through either network- or modem-interfaces. That way, the profiles or instruction sets can be downloaded from a link through an intranet or the internet, and so on.

Another aspect of the invention is if it further includes a manual command means. The manual command means not only operating the machine in a manual mode, but also programming or entering profiles for storage and retrieval by the equivalent of a RECORD mode. Thus the manual command means, more particularly, is provided for electrically controlling the gantry moving means, the pressing-unit moving means and the actuating means. It includes a manually-operated control having electrical outputs and signal delivery means for delivering signals at said outputs representative of movement of said manual control corresponding to desired X and Y directions of movement of the gantry and pressing unit, responsive means for responding to said signals for driving said gantry moving means and pressing unit moving means, and a switch for actuating the actuating means.

The processing circuitry is linked to the manual command means for recording in the RECORD mode a given instruction set corresponding to the manually-inputted movements entered by the manual command means of the gantry and pressing unit movements from one given X and Y coordinate to another, succeeding X and Y coordinate. The processing circuitry also associates each X and Y coordinate with an instruction to actuate the actuating means or not, or pausing in the PAUSE mode. That way, in a PLAYBACK mode, the processing circuitry can play back the given manually-recorded instruction set, as well as include pauses in the PAUSE mode during which a worker might remove one or more completed trusses and place back in the jig means sets of loose pre-cut truss members and connector plates. This all allows the repetitive fabrication of succeeding trusses during the corresponding play backs of the given manually-recorded instruction set.

It is preferred if the manually-operated control comprises a joystick, as configured with a centered neutral position. The aforementioned signals are related to the displacement of said joystick away from said centered neutral position. Alternatively, the manually-operated control may comprise either a keypad or keyboard and the like.

A way of achieving some of the above may include having the gantry moving means comprise an infinitely adjustable gantry valve operatively connected to at least one fluid-driven motor and a pair of proportional solenoids operatively connected to said gantry valve. Likewise, the pressing-unit moving means might have a similar infinitely adjustable valve, a fluid-driven motor and a pair of proportional solenoids. Given the foregoing, the signal delivery means would likely provide the signals in response to displacements of the joystick from the neutral position in order to drive the proportional solenoids.

Additional aspects and objects of the invention will be apparent in connection with the discussion further below of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 8 is a schematic of assorted program events for a control program therefor.

DETAILED DESCRIPTION OF THE PREFERRED EMBODIMENTS

Figures 1, 6:
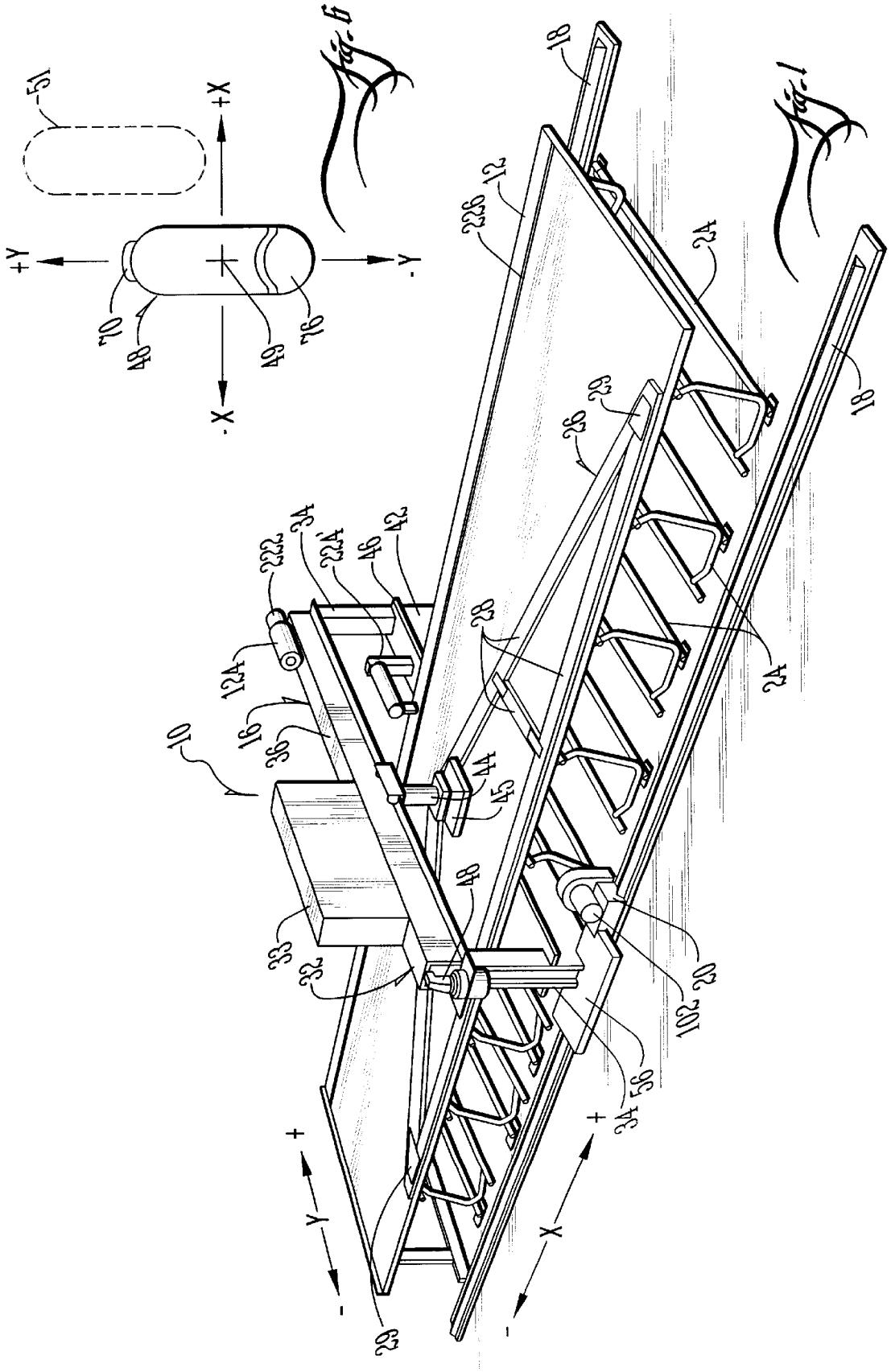
FIG. 1 is a perspective view of a truss fabricating machine according to the present invention including an automatic control system therefor and in accordance with the invention.
FIG. 6 is a schematic top plan view of the joystick illustrating the direction along which it can be displaced from its vertically centered neutral position.

Referring to FIG. 1, there is shown the truss fabricating machine 10 for joining precut pieces of lumber with pronged connector plates to form a roof truss or similar structure. The truss fabricating machine 10 includes a jigging table 12 for positioning the truss members and a pressing mechanism, generally 16.

The table 12 is disposed between two parallel tracks or rails 18 secured to the floor, upon which the pressing mechanism 16 rides in mating guides 20. The pressing mechanism 16 rides on the tracks or rails 18 along the X-axis, that is, the elongated dimension of the table 12.

The table 12 includes a working platform, or top 22, which is supported by a plurality of parallel shiftable supporting units 24 comprising legs that depress upon contact from the pressing mechanism 16 as it moves along the X-axis in either the positive (to the right in FIG. 1 as viewed from the operator s platform 56) or the negative X direction (to the left as viewed in FIG. 1 from the operator s platform 56), to permit the anvil portion of the pressing mechanism to pass beneath the tabletop according to principles well known in the prior art.

The platform or tabletop 22 has a base formed of any sturdy flat surface, but typically made from sheets of ¾ inch (1.9 cm) tongue and groove solid core plywood set edge to edge to form the base. As shown in U.S. Pat. No. 3,826,188—Eberle (the disclosure of which is fully incorporated herein by this reference thereto), a plurality of parallel, upwardly opening steel channels secured to the base may extend the length of the table 12 and have inwardly turned flanges which accommodate adjustable jigging pads. Fitted between the channels are filler pieces of wood such as ¾ inch (1.9 cm) plywood that in turn are covered by top pieces which may be ⅛ inch (0.3 cm) fiberboard. The upper surfaces of the top pieces should lie flush with the flanges on the channels.

The pressing mechanism 16 includes a frame 32 which in plan view extends parallel to the Y-axis and includes vertical support members 34 for holding the gantry 36 above the table 12 and parallel to the top of the table 12. The pressing mechanism 16 includes wheels 62 (see FIG. 2) contained within the carriages or guides 20, which ride on the tracks 18. Each carriage 20 includes a hydraulic motor 102 connected to the carriage wheels 62 through sprocket and chain drives for driving the pressing mechanism 16 along the X-axis. The frame 32 is welded to the carriages 20. A bridge bearing (not shown), that is, a pivot block attaching one carriage to one vertical support member 34 of the gantry 36, allows the carriage wheels to remain engaged on the tracks 18 even if the tracks 18 are not precisely parallel or have irregularities.

The pressing mechanism further includes a cross beam 42 that is parallel to the gantry 36, but travels under the table 12 and is also seated on bridge bearings. The cross beam 42 is used as an anvil to absorb the force of the press 44 when it drives down onto the truss 26. The truss 26 includes a plurality of truss members 28 laid on the tabletop 22 in the desired pattern with a connector plate 29 below the joints formed by adjoining members and a truss plate 29 lying on top of each joint, as the truss members are lying on the tabletop 22.

The cross beam 42 carries a top plate 46 that is somewhat wider than the box beam 42 and provides the surface of the anvil. The top plate is located at a height very slightly under the bottom surface of the table 12 so that it does not drag along the table when the pressing mechanism 16 is moved along the X-axis. Six rollers, with three positioned along each longitudinal edge of the top plate 46 contact the bottom of the table top 12 until the press 44 is actuated.

Figure 2:
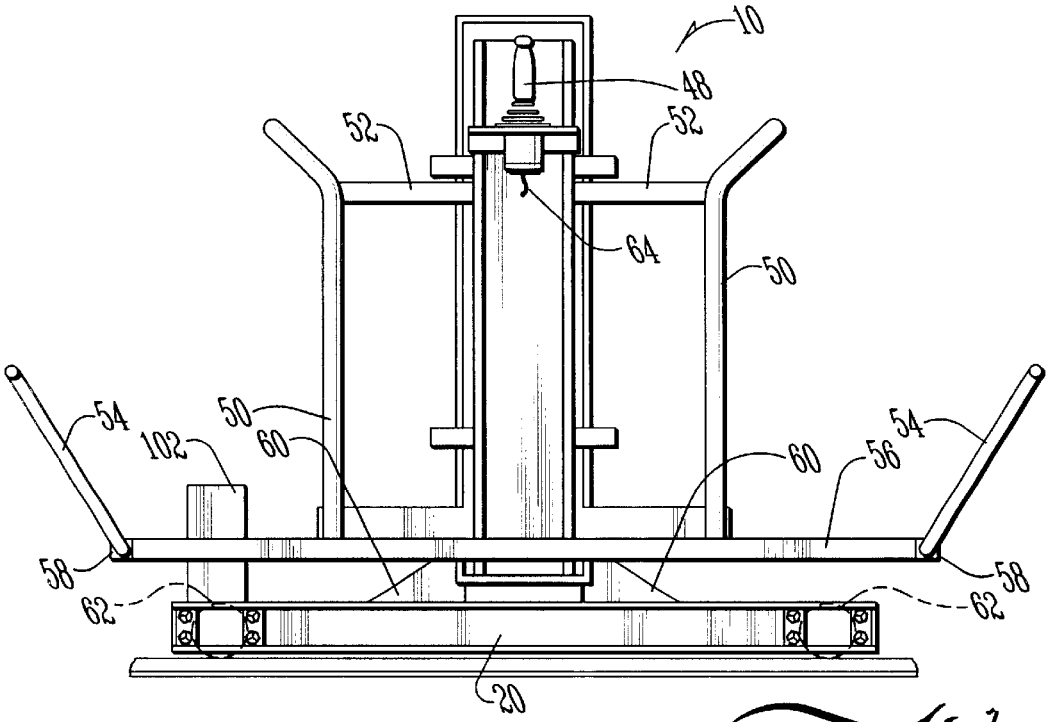
FIG. 2 is a front elevational view of the operator booth and truss fabricating machine of FIG. 1.

Referring to FIG. 2, the pressing mechanism 16 carries an operator's platform 56 where the operator stands to control the truss fabricating machine 10 by manipulating the joystick 48. The platform 56 includes protective side guard rails 50 and horizontal guard rails 52. Two safety switch stop bars 54 are mounted on the platform 56. The stop bars 54 are pivotally attached to the floor of the platform 56 by the pivot joints 58 and actuate a safety switch that stops all operation of the truss fabricating machine 10 when either one is pushed upward by a moderate force, such as that which would be encountered if the pressing mechanism 16 were to run into a person while traveling on the rails 18.

Still referring to FIG. 2, one X-axis or direction motor 102 is visible on the left-hand side of the working platform 22. Two drive motors 102 operating in unison are required, one on each side of the pressing mechanism 16, to provide true parallel travel of the two ends of the gantry 36 and to reduce the probability of the carriages 20 binding on the tracks 18.

The operator's platform 56 is joined to gantry 36 by suitable means such as welding. As an alternative, a separate operator s platform may be located on each side of the table 12 along with a separate joystick 48, allowing the truss fabricating machine to be operated from either side of the table. The gantry 36 also carries the control box 33 which includes much of the electrical circuitry and hydraulic equipment described below.

Figure 3:
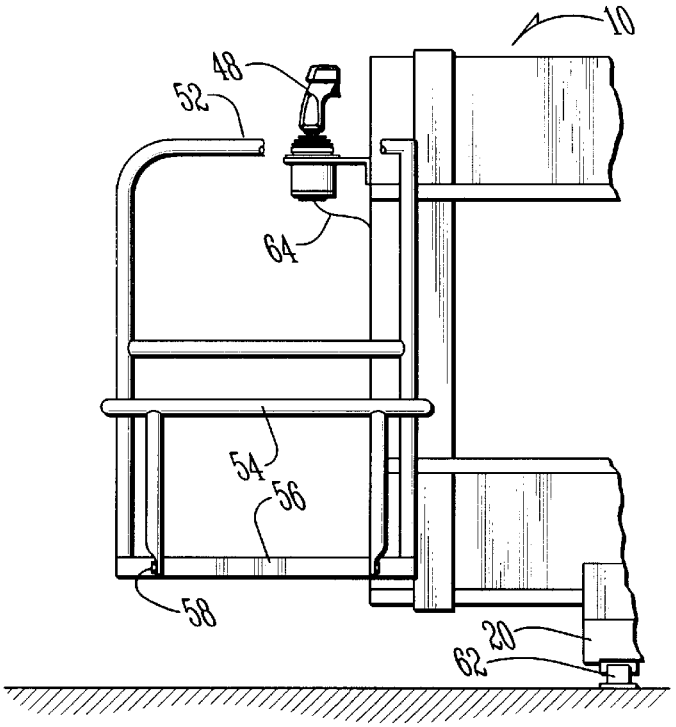
FIG. 3 is a side elevational view thereof.

Referring to FIG. 3, the joystick 48 is attached to electrical circuitry explained below by the electrical lead set 64, which transmits the electrical signals fed from the joystick 48 to the driver 100 (FIG. 5), described below. The signals developed by manipulation of the joystick 48 are related to the direction and magnitude of displacement of the joystick 48 from its central upright neutral position 49 (FIG. 6). Referring to FIG. 6, which is a schematic plan view of the joystick 48, it is shown that the top of the joystick 48 can be moved along the X-axis of the tabletop 22 with either positive (to the right) or negative (to the left) polarity and along the Y-axis of the table 22 with either positive (up in FIG. 6, or away from the operator s platform 56 in FIG. 1) or negative polarity (down in FIG. 6 or toward the operator s platform 56 in FIG. 1). As illustrated by the ghost-image 51 of the joystick 48, the joystick 48 can also be moved in any pattern or direction within the limits of its movements. Moving toward the ghost-image 51 produces signals causing the press 44 to move along both the X-axis and the Y-axis simultaneously. Regarding the axes, it could also be said that the joystick 48 itself has an X-axis and a Y-axis that are each parallel to the corresponding axes of the tabletop 22. The essential feature of use of the joystick 48 for control is that the movements of the press 44 mimic the movements of the joystick 48.

Figure 4:
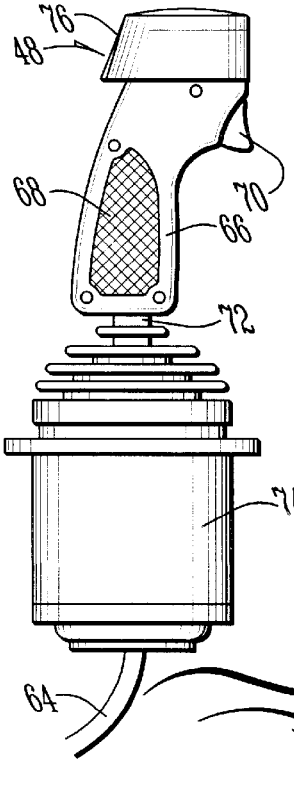
FIG. 4 is a side elevational view of the joystick in the operator booth and used to control manually the truss fabricating machine of FIG. 1.

Referring now to FIG. 4, there is shown an enlarged side elevation of the joystick 48, which includes a pistol grip 66 having cross-hatched friction ridge surfaces 68 and a trigger 70, which operates as a safety switch, for whenever the trigger 70 is released, the truss fabricating machine 10 stops. The trigger 70 is a normally open switch that controls a relay in the main control panel so that the entire truss fabricating machine 10 is deactivated when the trigger is released. When the trigger is depressed, the truss fabricating machine 10 is activated. The stem 72 supports the pistol grip 66 and its opposite end terminates in a ball and socket joint (not shown) inside the housing 74, wherein electrical circuitry converts the motion of the pistol grip 66 into related electrical signals that are ultimately used to actuate hydraulic valves for controlling motion of the press unit or pressing cylinder 44 along the X-axis and the Y-axis.

A thumb switch 76 is located in the top of the joystick 48 and can be moved either to the left or to the right as the operator faces the table 12. When moved in either direction, the thumb switch 76 energizes a relay 138 (FIG. 5) which controls operation of the hydraulic pressing cylinder 44 that, in turn, controls the up and down motion of its pressing head 45, as will be described in greater detail below.

The speed of the motion of the press 44 along either the X-axis or the Y-axis is proportional to the distance that the joystick is moved relative to its centered vertical normal position, which represents neutral and will not cause the gantry 36 or the press 44 to move along either the X-axis or the Y-axis.

A suitable joystick 48 is now manufactured by and available from P-Q Controls. Inc. of Bristol, Conn., U.S.A., and several other suppliers, and may include a 20° maximum travel along the Y-axis on either side of the vertical neutral position, a maximum of 15° on either side of the vertical neutral position along the X-axis, and a maximum 27° travel in any direction not directly along the X-axis or the Y-axis. The trigger has 0.28 inch (7 mm) total pull and requires 0.1 inches (2.5 mm) to switch. The voltage supply may be from 5 to 15 volts DC. The reference voltage is 50 percent of the voltage supply. The output when the pistol grip 66 handle is vertically centered is also 50 percent of the voltage supply, that is, the same as the reference voltage. Full positive deflection in any direction results in a signal of 60 percent of the voltage supply, while full negative deflection in any direction generates a signal having 40 percent of the voltage supply.

Figure 5:
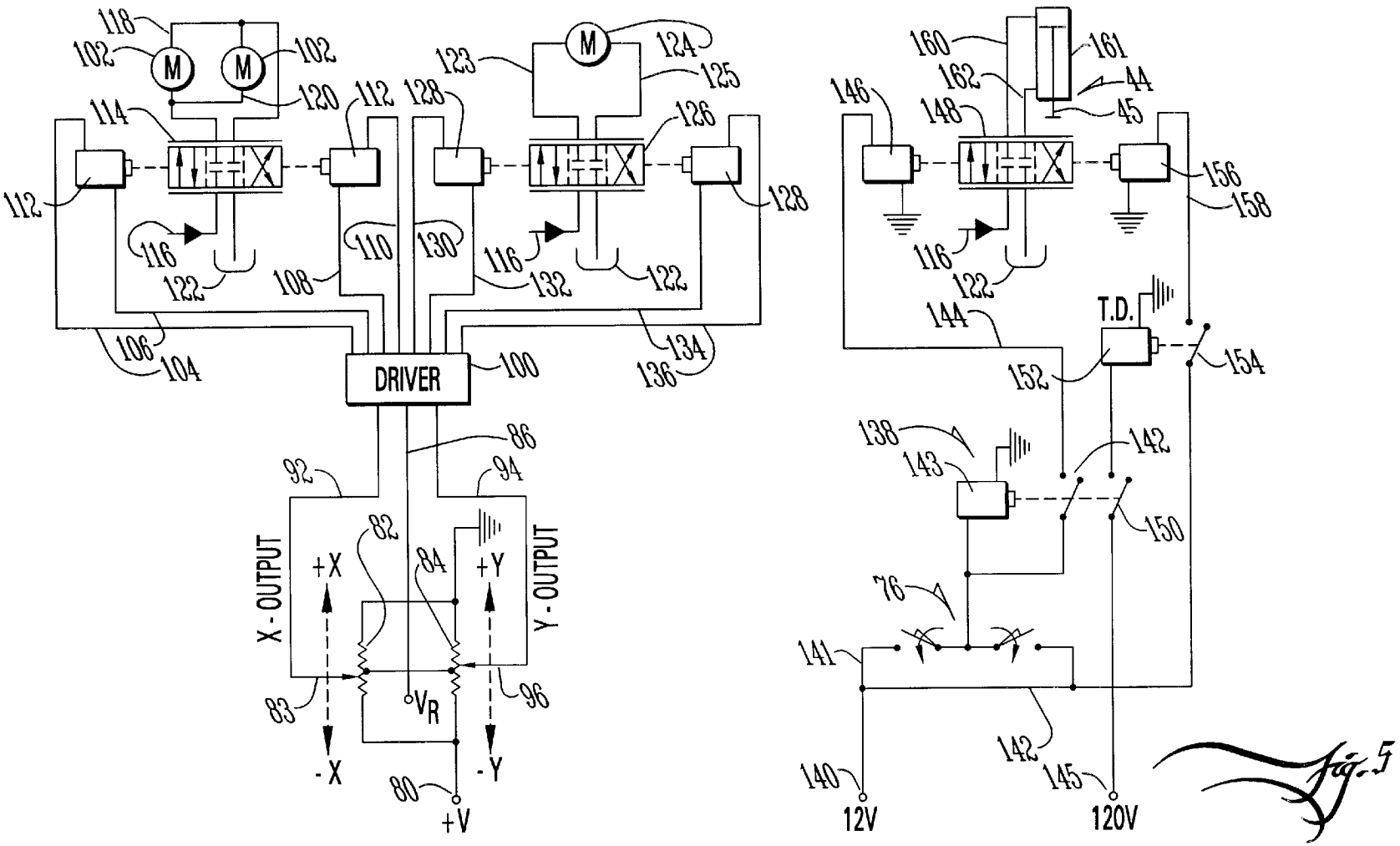
FIG. 5 is a schematic diagram of the electro-hydraulic control mechanisms, in part. of the truss fabricating machine of FIG. 1.

Referring now to FIG. 5, there is shown a schematic illustration of the electrohydraulic circuitry that controls the movement of the press 44. Other fluid-driven circuits. e.g. pneumatic, could easily be substituted for the hydraulic components of the system. The joystick 48 is schematically illustrated in the lower left-hand portion of FIG. 5. The joystick 48 utilizes a source voltage +V on the lead 80 from the control box 33 (FIG. 1), which may be between 5 and 15 volts DC and which is supplied to two grounded resistors, resistor 82 for the X-axis motion detection and resistor 84 for the Y-axis motion detection. The resistors 82, 84 are portions of potentiometers that are centered with the reference voltage, VR, along the lead 86. The point of contact of the lead 88 on the resistor 82 changes when the joystick 48 is moved from the centered vertical neutral position along the X-axis. The x output on the lead 92 thereby becomes a DC voltage that is proportional to the displacement of the joystick 48 away from its neutral centered position. The full positive deflection of 15° to the right as viewed from the operator's platform in FIG. 1 produces a signal of 60 percent of the voltage power supply, whereas the full negative deflection of 15° to the operator's left as viewed in FIG. 1 produces a voltage signal of 40 percent of the voltage supply.

Similarly, the y output on the lead 94 changes as the potentiometer contact 96 moves along the resistor 84 in response to movements of the joystick along the Y-axis. The y output signal on the lead 94 is also at the reference voltage when the joystick 48 is in the centered neutral position, 60 percent of the voltage supply when the joystick is in the full positive deflection, that is, away from the operator as illustrated in FIG. 1 by a maximum of 20° deflection from the vertical neutral position, and 40 percent of the voltage supply upon full negative deflection, that is, 20° away from the centered neutral position and toward the operator.

In the preferred embodiment, the internal mechanism of the joystick 48 allows the joystick to be moved at any angle within the cone described, leading to a maximum travel between axes of 27°. These movements create simultaneous x output and y output signals and will be acted on simultaneously by a driver 100, to produce movement of the press 44 along both the X-axis and the Y-axis simultaneously. That movement may describe a straight line at an angle of 45° from the origin 0 of FIG. 1, a curve, or any other of an infinite number of curves between two points, depending upon the combination of X-axis input and Y-axis input that the operator selects through his motions of the joystick 48.

The X output signal on the lead 92, the reference signal on the lead 86, and the Y output signal on the lead 94 are all transmitted to the driver 100, which is an electronic interface between a command source, namely the joystick 48, and an electrically modulated valve or transmission stroker such as the proportional solenoids employed here to actuate the hydraulic valves. A suitable driver is the model 516 currently manufactured by P-Q Controls, Inc. of Bristol, Conn., U.S.A. The driver 100 provides a ramp, or acceleration and deceleration, function causing a smoothed output to the valve regardless of the abruptness of signal changes from the command source, or joystick 48.

The driver 100 provides a current source output that can be configured to drive single coil, dual coil, or single coil polarity reversal (floating coil) valves. The electrical current output remains constant within 10 percent over a wide voltage supply swing, typically 10 to 30 volts DC, and a wide resistance shift, which occurs as the valve coil heats up. The command source can be a potentiometer, switch, or a joystick as is employed in the preferred embodiment.

Using the driver 100 to control the solenoids and valves described below enables the joystick 48 to be readily replaced by a programmable control or computer interface, which obviates the need for an operator to visually direct the machine from the operator's platform 56.

The output from the proportional channel outputs of the driver 100 is a pulse width modulated electrical signal with current monitoring to drive the proportional solenoids on the hydraulic valves. The frequency of the pulse width modulated output is more critical with some hydraulic valves, so the driver 100 is calibrated for both the frequency and voltage required to meet the operational specifications of the particular valve it drives. The frequency and magnitude of the driver outputs are also adjusted to counteract oscillations in hydraulic fluid output and excessive hysteresis.

The driver board 100 is powered by a regulated power supply (not shown), but can be operated from a vehicle battery in the field. The supply voltage +V should be free from AC ripple and DC spikes and have power capable of driving all functions under full load.

The leads 86, 92, 94, which provide the command source inputs to the driver 100 are shielded cables having grounded shields to eliminate interference.

Two hydraulic motors 102 control movement of the pressing mechanism 16 along the X-axis. The electrical signals on the leads 104, 106, 108, 110 actuate a pair of opposed proportional solenoids 112, which in turn control an infinite positioning four-way valve 114. A hydraulic pressure source 116 supplies the source of motive power through the hydraulic lines 118, 120 and the hydraulic fluid is returned to a reservoir 122 on the drain side of the hydraulic circuit.

Each of the proportional solenoids 112 shifts its armature a distance that is proportional to the strength of the triggering electrical signal delivered to the proportional solenoid 112. This action, in turn, causes the infinite positioning four-way valve 114 to regulate the flow of hydraulic fluid through the valve, and hence through the motors 102 throughout an infinite continuum of flow rates between the on and off states. This allows the motors 102 to control the speed at which the pressing mechanism 16 moves along the X-axis. This allows the operator to delicately control the rate of acceleration, deceleration. and the speed of the pressing mechanism 16 along the X-axis.

A similar arrangement drives the pressing cylinder 44 along the gantry itself, that is, along the Y-axis. The press 44 is suspended from the gantry 36 and rides therealong transversely of the table 12 in the manner as disclosed in the aforesaid Eberle '188 patent. A hydraulic motor 124 on the top of the gantry 36 is driven by hydraulic fluid flowing through the hydraulic lines 123, 125 from a hydraulic pressure source 116, and is routed through the hydraulic lines 125 into the drain side reservoir 122 when its energy has been expended. The direction of drive and rate of acceleration, deceleration and speed of the motor 124 are controlled by an infinite positioning four-way valve 126, whose flow rates are regulated by a pair of opposed proportional solenoids 128. The degree of engagement of the solenoids 128, in turn, is controlled by electrical signals from the driver 100 transmitted along the leads 130, 132, 134 and 136. The hydraulic motor 124 is connected to the press 44 by a sprocket and chain drive (not shown).

When the operator has moved the press 44 to a position directly above the connector plates, he actuates the thumb switch 76 at the top of the joystick 48, which is schematically represented in the lower right-hand portion of FIG. 5. The thumb switch 76 operates a relay 138 driven by the 12 volt power supply 140. The thumb switch 76 is normally in a neutral or off vertical position and can be toggled either to the left or the right with the same effect, namely engaging the pair of normally open switch contacts 142, which closes the 12 volt circuit along the lead 141 to actuate the relay coil 143 of the relay 138. This closes the normally open relay contacts 142, delivering 12 volts to the solenoid 146 along the lead 144. The solenoid 146 opens the four-way hydraulic valve to allow hydraulic fluid to be pumped into the upper chamber of the double acting hydraulic cylinder 161, causing the ram of the press 44 to move down through the full length of its stroke, thereby seating the connector plate. The operator must keep the thumb switch 76 engaged until the connector plate is seated.

Then the operator releases the thumb switch 76, cutting off the 12 volt supply that actuated the relay 138, and cutting off the electricity to the solenoid 146. While the relay 143 is actuated the normally closed contacts 150 of the relay 143 are opened, preventing current from reaching the relay coil of the time delay relay 152. When the operator releases the thumb switch 76 the contacts 150 of the relay 138 close, thereby delivering excitation from the 120 volt power source 145 to the time delay relay 152, which closes the contacts 154. This delivers 12 volts from the 12 volt power supply 140 along the lead 158 to the solenoid 156, which actuates the four-way valve 148 and allows hydraulic fluid to be pumped into the bottom chamber of the double acting hydraulic cylinder 161, thereby drawing the ram of the press 44 up to the top of its stroke. The time delay relay 152 remains on and keeps its contacts 154 closed long enough for the ram to rise to the top of its stroke without action by the operator. When the pressing ram reaches the top of its stroke, the time delay relay times out despite still being connected to the 120 volt power, and the contacts 154 are opened, the solenoid 156 is de-energized and the four-way valve 148 returns to a neutral position and releases pressure on the hydraulic fluid inside the cylinder 161, but keeps the ram stationary by not allowing fluid to flow into or out of the cylinder 161.

While certain forms of this invention have been illustrated and described herein, the invention is not limited thereto, except insofar as such limitations are included in the following claims.

Figure 7:
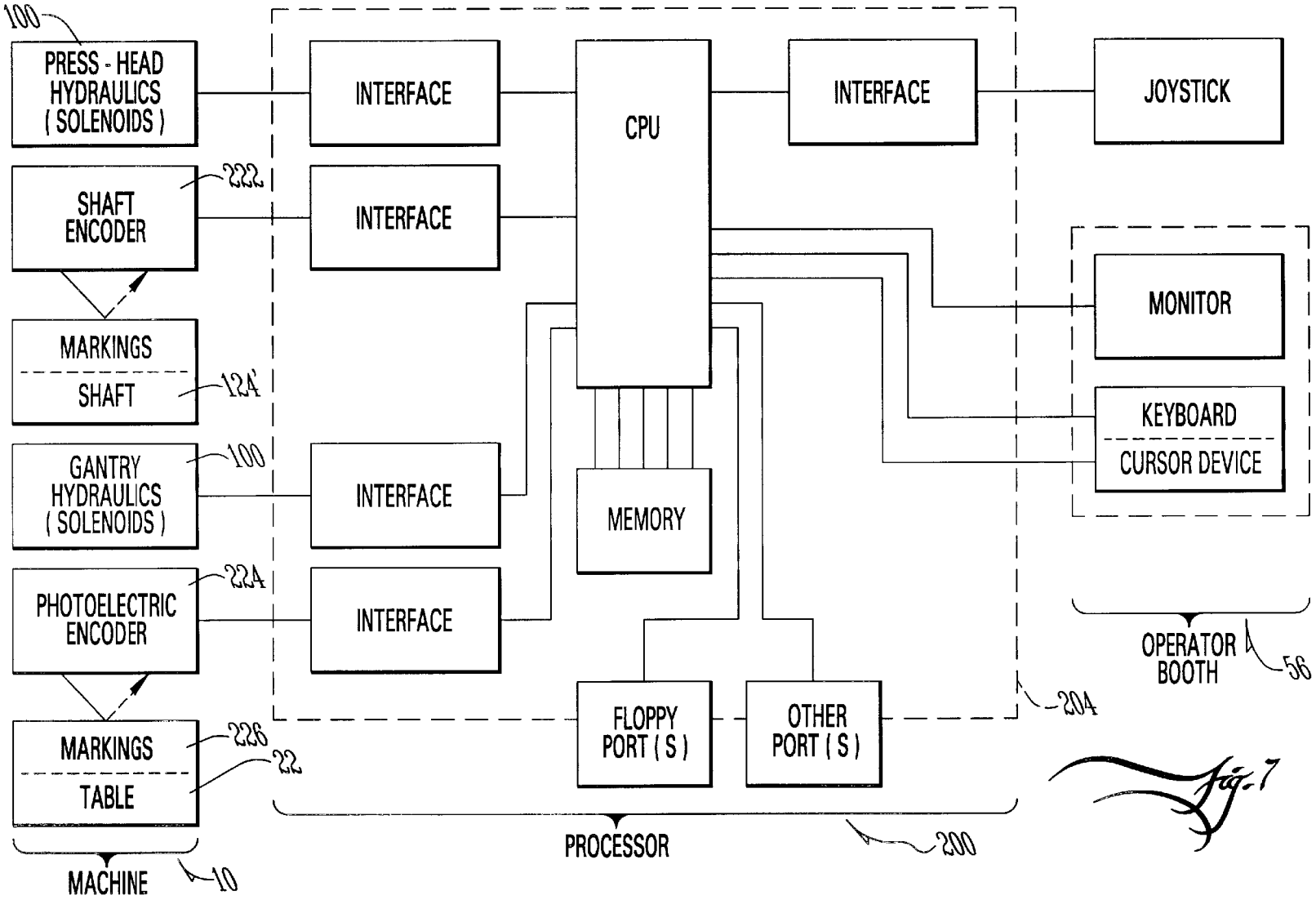
FIG. 7 is a schematic block diagram of the automatic control system for the truss fabricating machine of FIG. 1.

FIG. 7 shows an automatic control system 200 in accordance with the present invention. It includes a processor 204 for running an application program 210 having characteristics as shown by FIG. 8, which application program 210 manages the control system's operation.

The machine 10 of FIGS. 1–3 for fabricating trusses is given the following signal generators to track the X-Y displacement of the press-head. The Y-position of the press-head 44 is sensed by means of a shaft encoder 222 coupled to the shaft 124' of the motor 124 for the press-head 44. That is, the motor 124 shuttles the press-head 44 back and forth across the Y-axis by means of a chain and sprocket drive. The motor 124 turns drive shaft 124' which carries a drive sprocket which is meshed with a drive chain. The drive chain extends between opposite tag ends which forms nearly a perfect loop extending in a circuit around the drive sprocket on one extreme end of the gantry 32, to an idler sprocket on the opposite extreme end (ie., this opposite extreme being the end nearest the operator booth 56). The drive chain's tag ends are secured to the press head 44, which slides on complementary tracks for it in the gantry 32 top beam 36. Clockwise and counterclockwise rotation of the drive motor 124 causes back and forth traversing of the press-head 44 on the gantry 32 top beam 36.

By configuring the drive shaft 124' of drive motor 124 with the shaft encoder 222, the shaft encoder generates signals which though routine calibration can be corresponded to the differential displacement of the press-head 44 in the Y-axis. Referring to FIG. 7, the shaft encoder is conventional and comprises a photoelectric transceiver aimed at the motor shaft 124'. The motor shaft 124' configured with marking which can comprise, for example, alternating hatches of light and dark bars, or else absorptive and reflective bars and the like. The shaft encoder senses interruptions of the emitted beam and corresponds successive interruptions with frequency. Frequency, in turn, corresponds to not only shaft speed but also—by means of calibration—the actual physical displacement of the press-head 44. All this is well-known in the art. The shaft encoder 222 moreover tracks clockwise and counterclockwise rotation of the shaft 124', which corresponds to reverse directions of travel for the press-head 44.

A similar photoelectric encoder 224 device is used to signal the X-axis displacement of the gantry 32 over the tabletop 22. With joint reference to FIGS. 1 and 7, the tabletop 22 is configured with a marking stripe 226 that extends between the left and right edges of the tabletop 22. The marking stripe can comprise a series of uniform notches, the passage over of which by the photoelectric device on its boom 224' results in a series of interruptions in the reception of the emitted beam. As previously described in connection with the shaft encoder 222, the photoelectric encoder 224 corresponds the interruptions of the emitted beam with linear velocity. Linear velocity, by means of calibration, corresponds to the actual physical displacement of the gantry 32 in the X-axis over the tabletop 22. The photoelectric encoder 224 moreover tracks reversals in direction of travel of the gantry 32, which corresponds to flip-flops in positive- and negative-direction displacement of the gantry 32.

Referring more particularly to the automatic control system 200 of FIG. 7, it comprises a CPU for processing the functions of the system. The CPU is served by memory which may take the format of chip memory alone or in combination with storage media such as a main disk or hard drive (eg., a c:\drive for the CPU). The CPU is linked for communication of signals with the joystick 48, the Y-displacement (ie., shaft) encoder 222, the X-displacement encoder 224, and the press-head electro-hydraulic circuits as well as the gantry electro-hydraulic circuits (see, eg., driver 100 and the rest of the circuits illustrated by and described in connection with FIG. 5). The CPU and its memory can be physically configured in any suitable package including any off-the-shelf laptop computer or the like. Such an off-the-shelf laptop configuration would also include a display or monitor or virtual monitor, a keyboard or at least an abbreviated keypad, and perhaps a cursor-controlling device such as a track-ball or graphic tablet. In whatever physical format the CPU and its memory are packaged, the package is preferably stationed in or around the operator booth 56 for convenience for the operator to dually handle both the joystick and the CPU keyboard/keypad device(s).

Also, the CPU and its memory are provided with set(s) of communication ports for attaching or communicating with floppy or CD drives, another CPU memory (eg., which may alternatively be chip memory alone or else other main hard disk media or "c:" drive thereof, or combinations thereof), or else take the format of a printer port, a network interface and cable jack, or modem and phone jack, and so on. The use(s) of these ports will be described more particularly below in connection with loading programs and/or data files into the processor of the present invention.

FIG. 8 shows an assortment of various program events for the example application program 210 for controlling the processor of FIG. 7 axis given in connection with this written description. In one mode of its operation, the program allows an operator to manually press all the connector plates of a first truss in a series. Each time he lines up the press-head 44 for stroking down on a connector-plate/truss-joint, the operator concurrently signals the processor to "Record." After having recorded every position in sequence for the first truss in a batch, every successive truss in the batch can be run automatically by signaling the processor to "Playback." This is akin to a Re-dial function on a telephone. However, the application program 210 in accordance with the invention is configured with much higher level programming than that.

Execution of the program is begun by the Run command, which might alternatively be achieved by clicking an icon or the like. The program has multiple modes including "Begin Recording," "Play," "Save," "Edit," "Copy " and so on. The following various program events are associate with "Begin Recording" mode.

By way of background, it is conventional to set-up the truss machine 10 to run a batch of like identical trusses. There are appropriate jig stops that are set-up for holding all the pre-cut lumber pieces in the correct place. That way the joints (and the corresponding placement of the connector plates) more or less always land on the same spot on the tabletop 22. In other words, these "spots" or positions are effectively the "same" given that the press plate 45 measures quite big as the connector plates correspondingly present a relatively small target. More simply, there is room for minor overshoot in both the X- and Y-directions. The large press plate 45 is going to sufficiently compress any connector plates within the neighborhood.

An inventive aspect of the present invention is that once the processor is supplied with a profile of a given truss representative of a batch of identical or substantially "like" trusses, the processor can automatically sequence the press-head into all the positions of all the connector plates and stroke down at the appropriate positions. The processor can operate in various ways. It can be given a Home position, which might be the left near (eg., left near in FIG. 1) comer of the tabletop 22. That way, the press-head 44 and gantry 32 can be commended to cycle or "run" through the sequence of a given truss profile, and finish up by returning to Home and pausing there in a "standby" mode. The operator stacks aside the completed truss, reloads pre-cut lumber and connector plates for the next truss, and then commands the processor to "Playback" the profile. Which in response, the press-head 44 and gantry 32 are cycled through the sequence of the same given truss profile, after which they return to Home and standby. Hence a second truss has been completed and is ready for stacking aside.

In an alternate mode of operation, perhaps the gantry sweeps right for odd-numbered trusses, and after idling at the right-side of the tabletop 22 it reverses and sweeps left for even-numbered trusses (idling on the left after completion of left-direction sweep).

By either mode (eg., return to Home after every circuit or alternately sweep left and then right), the advantages of the present invention include that the press-head can be run as fast and efficiently as desired, and at a more repetitively consistent rate than can ever be accomplished by hand alone. More significantly, the processor directs the press-head 44 to proceed between successive press positions on a straight line, accelerating and decelerating at pre-programmed-defined extremes of speed-up and speed-down rates in accordance with design protocols established for the equipment. An operator can never consistently run the equipment at its optimum speed-up and speed-down rates unerringly each time; running the equipment too hard results in needless wear and tear while running the equipment at sub-par levels results in lost efficiency. Moreover, some truss profiles are used for the production of such a large number of trusses that the execution routines which correspond to such programs justify optimization. Such an optimization of the profile would include coursing the press-head 44 through the most efficient route possible, with the greatest speed, to reach and hit every press position. These and other aspects and objects will be apparent with the following brief discussion of FIG. 8.

The operator has the choice of a "Select Record Mode—Joystick Mode." In this mode, the press-head 44 is moved to a position and then the operator enters that position in memory. The coordinates of that position are given cooperatively by the X- and Y-displacement encoders, 224 and 222 respectively. Also, the operator must "Select" or preselect a parameter or command to be associated with that position. For example. the first position the operator might enter is the Origin position, which corresponds to the (x=0, y=0) coordinate. In the industry there is already some acceptance among truss designers that the origin position corresponds to the "heel" of the truss, which in FIG. 1 corresponds to the far left corner of the truss on the table.

For a second example, the operator might move the gantry (ie., indicated by reference numeral 32) five feet (1.5 m) to the left of the Origin position. While doing so, the X- and Y-displacement encoders 224 and 222 are feeding the CPU with signals corresponding to the physical displacement of the press-head 44 from the Origin position. At the remote position, the operator might enter the coordinates and associate the Home parameter with these coordinates. Hence this second position becomes the Home position. Home is where (or at least one place where) the gantry 32 and press-head 44 might stand-by while a worker removes completed trusses and sets-up next trusses. Following entry of the Home position, the operator might cycle through all the press positions, entering each into memory, and associating each with the command "Move Head to press position (x,y) and Press." At the completion of the cycle, the operator might move the gantry 32 and press-head 44 in a remote spot and enter "Move Head to this standby position (x,y) and Standby." Other available commands to the operator include "Home," which is a command to move Head to the Home position and idle in Standby mode. The "Origin" command commands the Head to move to the Origin position and idle in Standby mode, and so on.

After having cycled through a profile, the operator may next enter the "Save and compile" command. The current sequence of commands—which comprise the current or open "document" for the application program 210—is then compiled into an executable file, and saved in memory. The operator is queried for a filename, and automatically the programs quits the "Begin Recording" mode.

If the next entry is "Play" the processor will cycle the gantry 32 and press-head 44 through the subject profile, which at the finish finds the gantry 32 and press-head 44 idle and standing by.

An alternative mode of loading a profile is simply manually keying-in the positions and associated commands by the keyboard/keypad device(s). For this purpose there is a "Select Record Mode—Key-In Mode."

A "Pause" command is provided to Pause Recording or Playing. What is briefly described next are various program events associated with "Play," "Edit, " and "Copy" modes and so on.

The "Play" command begins Play or resumes Play after Pause or standby with the current document or executable file. "Edit" allows editing of commands, parameters, the actual x- and y-cordinates associated with each command or parameter, or change the sequence thereof. The "Close" command closes the current document (ie., profile) and allows the operator to enter in memory or retrieve from memory another profile. As a safeguard, the Close command queries if it Closes the current document without saving changes.

The "Copy" utility allows several advantages. Copy allows copying into memory the execution files, merge files or data files from any other folder or linked media or drive. By way of background, an execution file is a complete file with both commands and x- and y-coordinate data. A data file is more basically a table of x- and y-coordinate data, which is non-executable unless associated with corresponding commands. A merge file contains such corresponding commands. The "Merge" command associates such a merge tile with an applicable data file. The "Command editor" allows development of merge files.

To return to the "Copy" utility, it allows loading into memory a canned profile either by way of a floppy disk or by cable from the drive of another processor. It is foreseeable that designers of trusses might provide canned routines on floppy or over the Internet for loading into the memory of such an automatic control system in accordance with the invention. That way, profiles are pre-programmed and these pre-programmed routines may be provided as a service by the original designers of the trusses. For loading such pre-programmed routines, the CPU is attached to one or more floppy port(s) and other port(s) as may allow a cable and/or modem connection.

To call a pre-programmed routine from memory, the operator enters "Open" and then selects the file by its filename. The operator then has available all the utilities of this application program 210, including "Play" and "Edit" and so on. Needless to say, the application program 210 preferably includes a Quit option to quit the program.

For convenience of configuring the processor 200 in accordance with the invention, it can be operated by any suitable readily-available off-the-shelf operating system such as a Microsoft® Windows® product, including for example Windows 98®. The program 210 in accordance with the invention as shown by FIG. 8 is substantially adapted from the "Macro" utility of the WordPerfect® word processing program, versions 6.0 and higher (nowadays a product of the Corel Corporation, Ltd.). Indeed, incorporated herein by this reference thereto are both the chapter from the "WordPerfect® version 6.0 for Windows User's Guide" entitled "Macros," and Lesson 31 thereof also entitled "Macros," as if both passages were reproduced fully herein.

The invention having been disclosed in connection with the foregoing variations and examples additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A truss fabrication machine comprising:

a table, having a tabletop defined with a given X-axis and a transverse Y-axis;

jig means on the tabletop for establishing the arrangement of manually-placed sets of loose pre-cut truss members and the connector plates at the joints therebetween for at least a single truss;

a pressing unit, including an extensible and retractable pressing head, and operable to extend said head toward and onto said tabletop and to retract it;

a gantry above said tabletop for carrying the pressing unit along said gantry as generally parallel to the Y-axis;

track and carriage means for carrying said gantry to travel along said track and carriage means as generally parallel to the X-axis;

gantry moving means for moving said gantry along said track and carriage means;

pressing-unit moving means for moving said pressing unit along said gantry;

actuating means for actuating said pressing unit whereby said pressing head extends to seat the connector plates into the truss members;

X-axis sensing means for sensing X-axis displacement of one of the gantry or the pressing unit;

Y-axis sensing means for sensing Y-axis displacement of the pressing unit; and, processing circuitry linked to at least one instruction-set storage device stored with at least one given instruction set, and having at least a RUN mode including a PAUSE mode;

wherein said processing circuitry is given control over said gantry moving means, pressing-unit moving means and actuating means concurrently while in the RUN mode responding to the X-axis and Y-axis sensing means for running in accordance with the given instruction set by • coordinating movement of said gantry and pressing unit and thereby positioning the pressing unit from one given X and Y coordinate to another, succeeding X and Y coordinate, and then • actuating or not the actuating means, or pausing in the PAUSE mode sufficiently to allow a worker to remove one or more completed trusses and place back in the jig means sets of loose pre-cut truss members and the connector plates therefor for repetitive fabrication of succeeding trusses.

2. The truss fabrication machine of claim 1 wherein said pressing-unit moving means comprises a motor, a drive shaft, and a drive transmission for driving the pressing unit along the gantry, and, wherein said Y-axis sensing means comprises a shaft encoder for generating signals corresponding to Y-axis displacement.

3. The truss fabrication machine of claim 2 wherein said drive transmission comprises a chain and sprocket arrangement.

4. The truss fabrication machine of claim 1 wherein said X-axis sensing means comprises a photoelectric encoder mounted to one of the gantry or track and carriage means and aimed at a strip on one of the tabletop or table having photoelectric graduations allowing the photoelectric encoder to generate signals corresponding to X-axis displacement of the gantry.

5. The truss fabrication machine of claim 4 wherein said photoelectric graduations comprise one of a marking stripe having dark and light alternations or a series of uniform notches.

6. The truss fabrication machine of claim 1, wherein said processing circuitry is provided with communication paths and ports sufficient for accessing the at least one given instruction set from storage in or on any of chip memory, a hard disk, a floppy disk, a CD, or from alternative other remote devices accessible through either network- or modem-interfaces.

7. The truss fabrication machine of claim 1, further comprising manual command means for electrically controlling the gantry moving means, pressing-unit moving means and actuating means, including a manually-operated control having electrical outputs and signal delivery means for delivering signals at said outputs representative of movement of said manual control corresponding to desired X and Y directions of movement of the gantry and pressing unit, and responsive means for responding to said signals for driving said gantry moving means and pressing unit moving means.

8. A truss fabrication machine as claimed in claim 7, wherein said manually-operated control comprises a joystick having a centered neutral position, said signals having a relationship to the displacement of said joystick away from said centered neutral position.

9. A truss fabrication machine as claimed in claim 8, wherein said gantry moving means further comprises an infinitely adjustable gantry valve operatively connected to at least one fluid-driven motor and a pair of proportional solenoids operatively connected to said gantry valve, and said pressing-unit moving means further comprises an infinitely adjustable pressing-unit valve operatively connected to a fluid-driven motor and a pair of proportional solenoids operatively connected to said pressing unit-valve, and wherein said signal delivery means provides said signals in response to displacements of said joystick from said neutral position for driving said proportional solenoids.

10. A truss fabrication machine comprising:

a table, having a tabletop defined with a given X-axis and a transverse Y-axis;

jig means on the tabletop for establishing the arrangement of manually-placed sets of loose pre-cut truss members and the connector plates at the joints therebetween for at least a single truss;

a pressing unit including an extensible and retractable pressing head and operable to extend said head toward and onto said tabletop and to retract it;

a gantry above said tabletop for carrying the pressing unit for travel along said gantry as generally parallel to the Y-axis;

track and carriage means for carrying said gantry to travel along said track and carriage means as generally parallel to the X-axis;

gantry moving means for moving said gantry along said track and carriage means;

pressing-unit moving means for moving said pressing unit along said gantry;

actuating means for actuating said pressing unit whereby said pressing head extends to seat the connector plates into the truss members;

X-axis sensing means for sensing X-axis displacement of one of the gantry or the pressing unit;

Y-axis sensing means for sensing Y-axis displacement of the pressing unit;

computer-implemented control circuitry linked to at least one instruction-set storage device for storing at least one instruction set, and having at least RECORD and PLAYBACK modes as well as including a PAUSE mode; and, manual command means for electrically controlling the gantry moving means pressing-unit moving means and actuating means, and including a manually-operated control having electrical outputs and signal delivery means for delivering signals at said outputs representative of movement of said manual control corresponding to desired X and Y directions of movement of the gantry and pressing unit, responsive means for responding to said signals for driving said gantry moving means and pressing-unit moving means, and a manual switch for actuating the actuating means;

wherein said computer-implemented control circuitry is further linked to said manual command means and the X-axis and Y-axis sensing means for recording in the RECORD mode a given instruction set corresponding to the manually-inputted movements entered by the manual command means of said gantry and pressing unit movements from one given X and Y coordinate to another, succeeding X and Y coordinate, and then associating each X and Y coordinate with an instruction to actuate the actuating means or not, or pausing in the PAUSE mode; and, wherein said computer-implemented control circuitry in the PLAYBACK mode is given control over said gantry moving means, pressing-unit moving means and actuating means concurrently while responding to the X-axis and Y-axis sensing means for playing back the given instruction set as well as including pausing in the PAUSE mode during which a worker might remove one or more completed trusses and place back in the jig means sets of loose pre-cut truss members and the connector plates therefor, for repetitive fabrication of succeeding trusses during corresponding to play backs of the given instruction set.

11. The truss fabrication machine of claim 10 wherein said pressing-unit moving means comprises a motor, a drive shaft, and a drive transmission for driving the pressing unit along the gantry, and, wherein said Y-axis sensing means comprises a shaft encoder for generating signals corresponding to Y-axis displacement.

12. The truss fabrication machine of claim 10 wherein said X-axis sensing means comprises a photoelectric encoder mounted to one of the gantry or track and carriage means and aimed at a strip on one of the tabletop or table having photoelectric graduations allowing the photoelectric encoder to generate signals corresponding to X-axis displacement of the gantry.

13. The truss fabrication machine of claim 10, wherein said computer-implemented control circuitry is provided with communication paths and ports sufficient for accessing other instruction sets from storage in or on any of chip memory, a hard disk, a floppy disk, a CD, or from alternative other remote devices accessible through either network- or modem-interfaces.

14. A truss fabrication machine as claimed in claim 10, wherein said manually-operated control comprises a joystick having a centered neutral position, said signals having a relationship to the displacement of said joystick away from said centered neutral position.

15. A truss fabrication machine as claimed in claim 14, wherein said gantry moving means further comprises an infinitely adjustable gantry valve operatively connected to at least one fluid-driven motor and a pair of proportional solenoids operatively connected to said gantry valve, and said pressing-unit moving means further comprises an infinitely adjustable pressing-unit valve operatively connected to a fluid-driven motor and a pair of proportional solenoids operatively connected to said pressing unit-valve, and wherein said signal delivery means provides said signals in response to displacements of said joystick from said neutral position for driving said proportional solenoids.

16. A truss fabrication machine comprising:

a table having a tabletop having a given X-axis and a transverse Y-axis;

jig means on the tabletop for establishing positions of manually-placed sets of loose pre-cut truss members and the connector plates at the joints therebetween for at least a single truss;

a pressing unit including an extensible and retractable pressing head, and operable to extend said head toward and onto said tabletop and to retract the same;

a gantry above said tabletop for carrying the pressing unit for travel along said gantry as generally parallel to the Y-axis;

track and carriage means for carrying said gantry to travel along said track and carriage means as generally parallel to the X-axis;

gantry moving means for moving said gantry along said track and carriage means;

pressing-unit moving means for moving said pressing unit along said gantry;

actuating means for actuating said pressing unit whereby said pressing head extends to seat the connector plates into the truss members;

X-axis sensing means for sensing X-axis displacement of one of the gantry or the pressing unit;

Y-axis sensing means for sensing Y-axis displacement of the pressing unit; and, processor circuitry operative in accordance with a processor-coded profile of the diverse X- and Y-positions at which the pressing head is actuated for the fabrication of at least one truss;

wherein said processing circuitry is given control over said gantry moving means, pressing-unit moving means and actuating means concurrently while responding to the X-axis and Y-axis sensing means for running a given profile by • coordinating movement of said gantry and pressing unit and thereby positioning the pressing unit from one given X and Y position to succeeding X and Y positions, and then • actuating or not the actuating means, or pausing in a standby mode following completion of the given profile sufficiently long to allow a worker to remove one or more completed trusses and place back in the jig means sets of loose pre-cut truss members and the connector plates therefor for repetitive fabrication of succeeding trusses.

17. The truss fabrication machine of claim 16, wherein said processing circuitry is provided with communication paths and ports sufficient for accessing other processor-coded profiles from storage in or on any of chip memory, a hard disk, a floppy disk, a CD, or from alternative other remote devices accessible through either network- or modem-interfaces.

18. A truss fabrication machine as claimed in claim 16, further comprising a manual command means for electrically controlling the gantry moving means, pressing-unit moving means and actuating means, and including a manually-operated control having electrical outputs and signal delivery means for delivering signals at said outputs representative of movement of said manual control corresponding to desired X and Y directions of movement of the gantry and pressing unit, responsive means for responding to said signals for driving said gantry moving means and pressing-unit moving means, and a manual switch for actuating the actuating means;

wherein said processing circuitry is further linked to said manual command means and the X-axis and Y-axis sensing means for recording in a RECORD mode a profile that corresponds to the manually-inputted movements entered by the manual command means of said gantry and pressing unit movements from one given X and Y position to succeeding X and Y positions, and associating each X and Y position with an instruction to actuate the actuating means or not, or pause in standby mode; and, for allowing playback in PLAYBACK mode of said recorded profile for repetitive fabrication of succeeding trusses during corresponding to successive play backs thereof.

19. A truss fabrication machine as claimed in claim 18, wherein said manually-operated control comprises one of a keypad, a keyboard, or a joystick;

wherein said joystick has a centered neutral position, said signals having a relationship to the displacement of said joystick away from said centered neutral position.

20. A truss fabrication machine as claimed in claim 18, wherein said processing circuitry is configured with and editor for coding and editing processor-coded profiles.

* * * * *